US007330125B2

(12) United States Patent
Sistare

(10) Patent No.: US 7,330,125 B2
(45) Date of Patent: Feb. 12, 2008

(54) DIRECTIONAL SOUND SYSTEM WITH MESSAGING

(75) Inventor: Paul J. Sistare, St. Charles, IL (US)

(73) Assignee: Honeywell International, Inc., Morristown, NJ (US)

( * ) Notice: Subject to any disclaimer, the term of this patent is extended or adjusted under 35 U.S.C. 154(b) by 268 days.

(21) Appl. No.: 11/090,536

(22) Filed: Mar. 25, 2005

(65) Prior Publication Data

US 2006/0214809 A1 Sep. 28, 2006

(51) Int. Cl.
*G08B 17/10* (2006.01)

(52) U.S. Cl. ..... 340/628; 340/506; 340/521; 340/517

(58) Field of Classification Search ..... 340/506, 340/521, 691.1, 511, 517, 628, 332, 691.5, 340/629

See application file for complete search history.

(56) References Cited

U.S. PATENT DOCUMENTS 4,288,789 A * 9/1981 Molinick et al. ..... 340/524
4,385,586 A * 5/1983 Schriever ..... 116/205
4,812,821 A * 3/1989 Santy et al. ..... 340/538
6,150,943 A * 11/2000 Lehman et al. ..... 340/628
6,201,470 B1 3/2001 Withington ..... 340/384.7
6,518,878 B1 * 2/2003 Skoff ..... 340/506

OTHER PUBLICATIONS

U.S. Appl. No. 10/734,691, filed Dec. 12, 2003, Hawkinson.
Wijngaarden, Sander J.. Bronkhorst, Adelbert W., & Boer, Louis C., "Auditory Evacuation Beacons." J. Audio Eng. Soc., vol. 53, No. 1/2. published Apr. 7, 2004.

* cited by examiner

*Primary Examiner*—Anh V. La
(74) *Attorney, Agent, or Firm*—Welsh & Katz, Ltd.

(57) ABSTRACT

An exit path indicating device incorporates at least a first port for receiving an alarm indicating signal. In normal operation upon receipt of the alarm indicating signal, the device outputs verbal and non-verbal indicators of the presence of an alarm condition for use in evacuating the region. A second port disables the non-verbal outputs. The second port can be coupled to a local sensor which provides an indication of a hazardous or alarm condition adjacent to or on the exit or egress path. If the sensor is indicating the presence of a hazardous or alarm condition, the non-verbal outputs can be disabled, while verbal directions can continue to be emitted.

16 Claims, 2 Drawing Sheets

DIRECTIONAL SOUND SYSTEM WITH MESSAGING

FIELD OF THE INVENTION

The invention pertains to an indicating devices of a type used in alarm systems for indicating exit paths in the event of an alarm condition. More particularly, the invention pertains to directional sounders which can also emit predetermined verbal messages during emergencies.

BACKGROUND

It has been known to install evacuation path or exit path indicating devices in regions being monitored to assist individuals in the respective regions to evacuate the region in the event of an alarm condition. Such devices provide either visual indicators, such as strobe lights or other types of exit identifying symbols, or audible indicators, such as sounders, or both, of the presence of an exit or an evacuation path. One known type of device is a broadband directional sounder.

Unfortunately at times when an alarm condition is present, such as a fire for example, it may not be apparent what the emitted sound is associated with. For example, the sound might be intended to identify the location of one or more sets of stairs. Alternately, the sounder might be part of a group positioned along an evacuation path to indicate an evacuation direction.

In addition to the above, one or more of the evacuation paths or exits might become unsuitable for use. Conditions that might result in unsuitability would include the presence of fire or smoke adjacent to, or, on the respective evacuation path or at the respective exit. One evacuation path indicating system has been disclosed and claimed in U.S. patent application Ser. No. 10/734,691 filed Dec. 12, 2003 entitled "System and Method of Disabling an Evacuation Location Device" assigned to the assignee hereof and incorporated herein by reference.

It would be desirable to be able to provide supplemental information to individuals in the region as to the meanings of sounds being emitted by respective devices in the respective region. Preferably such information could be provided without substantially increasing the cost of the devices. Also, it would be preferably if such functionality could be readily incorporated into existing systems.

DESCRIPTION OF THE PREFERRED EMBODIMENTS

Figure 1:
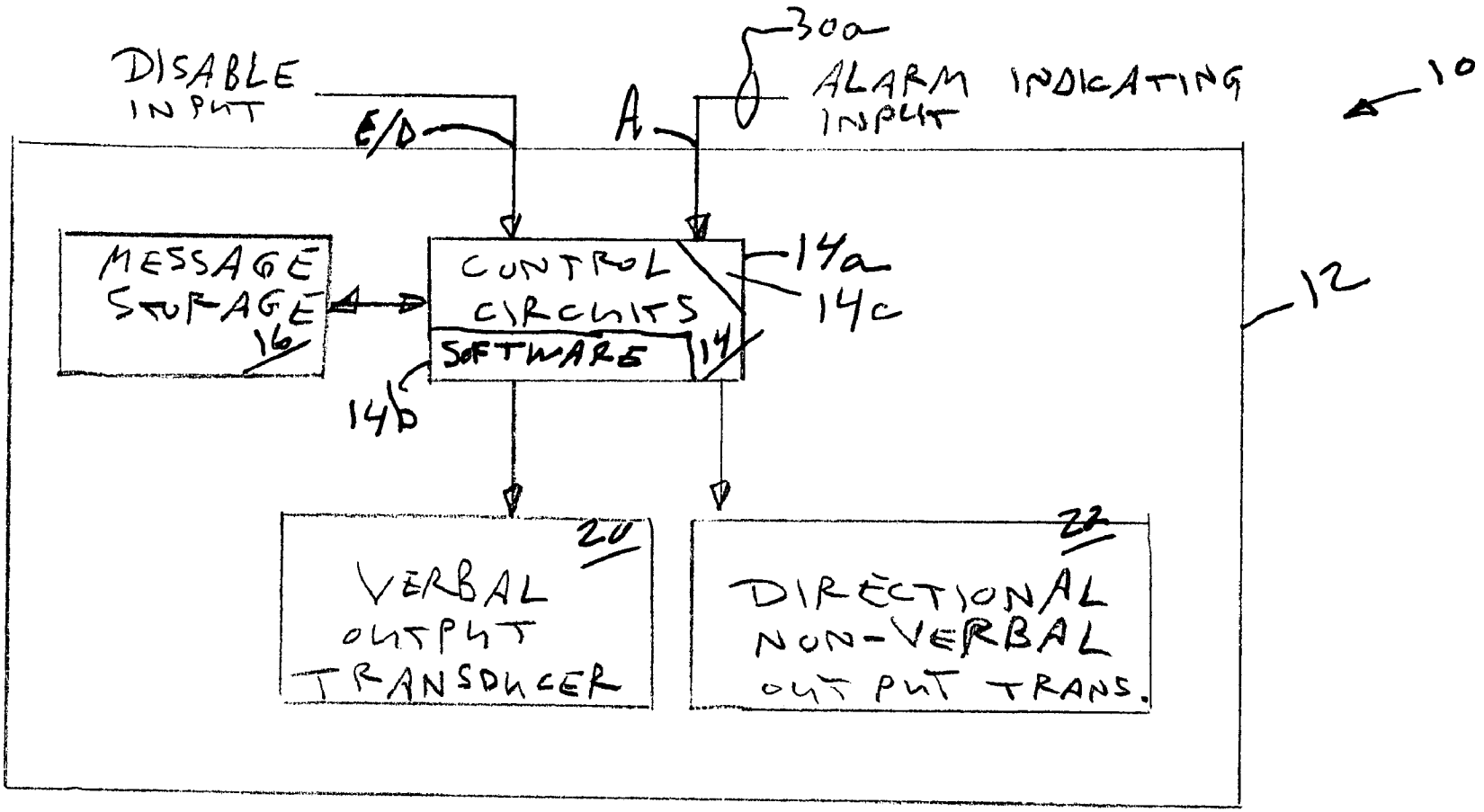
FIG. 1 is block diagram of a sounder with verbal output.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 is a block diagram of a directional audible device with voice 10. The device 10 has a housing 12 which carries a control element or control circuit 14. Control element 14 could be implemented with a variety of technologies without departing from the spirit and scope of the invention. Electromechanical relays could be used as well as solid state circuitry all without limitation.

In a preferred embodiment, a programmable processor 14*a* and control instructions 14*b* interact and provide the desired control functions. The device 10 can include address detection circuitry 14*c* to respond to only those signals that arrive at port A with a matching address.

Message storing circuitry 16 can be coupled to control element 14. Circuitry 16 can be implemented with a variety of technologies to provide programmable read-only memory. One exemplary type of memory is flash memory.

Control element 14 receives two different input signals. An alarm input signal can be coupled to an alarm input port A for purposes of activating the device 10. A second, optional, port E/D can be used to enable or disable the device 10 as described in more detail subsequently. Control element 14 is coupled to a verbal output transducer 20 and a directional non-verbal output transducer 22. Transducers 20, 22 could be integrated into a common housing. Depending on its construction, a single transducer might be usable.

As those that are skilled in the art will understand, in the presence of an alarm input at port A, the unit 10 provides directional non-verbal alarm indicating audible output signals, via transducer 22. Visual output indicators, such as illuminated symbols or flashing strobe lights can also be included to indicate to individuals in the vicinity the location of an exit or egress path.

Verbal output transducer 20 can be driven by predetermined messages, message storage 16, to supplement the alarm indicating nature of the directional audible output emitted by transducer 22. Exemplary messages can include but are not limited to:

"stairs going up"
"stairs going down"
"pass through to the next sounder"
"follow this sounder to an exit"
"exit here"
"area of refuge"
"safe area"
"keep away, fire"
"keep away, leaking gas"

It will be understood, as noted above, that in addition to verbally providing a variety of directions, or information the messages can also identify an area of refuge or safe area. In addition, the verbal messages could warn individuals in the region R of the existence of a hazard to avoid.

Messages can be specified by indicia received at port A from the monitoring system. Alternately, messages can be downloaded to device(s) 10 via port A from the monitoring system. Verbal and non-verbal outputs from devices(s) 10 can be alternated.

As would be known by those skilled in the art, the alarm input signal which would activate a plurality of devices, such as the device 10, does not take into account the local conditions in the vicinity of the device 10 at that time. In the prior art, the output devices are automatically activated inspective of local conditions in response to the alarm input signal.

In one embodiment of the present invention, the output device(s) 10 are coupled to an ambient condition detector which could be locally positioned relative to the device 10. The detector could, for example, be a fire detector such as a smoke detector, flame, or gas detector without limitation.

An output signal from the detector, coupled to the E/D port of the unit 10 can be used to disable the unit 10 in the presence of a locally sensed, hazardous, smoke or fire condition. For example, if a regional alarm system has activated the devices 10 via the port A, and, if some of the devices 10 which might indicate an escape path are in the vicinity of the fire, it might be desirable to disable the directional transducer 22 of those devices so as to not cause individuals in the region to expose themselves to the fire.

In a configuration as above, by coupling locally situated detectors to the E/D port of device 10, the operation of those devices which are adjacent to or near the fire condition could be altered. For example, the transducer 22 could be disabled while the verbal output transducer 20 could continue to emit verbal messages, as noted above. This local supplemental information, which can also reflect the signals at the E/D port, as well as port A provides a substantially greater range of communications than would be available if only directional non-verbal, audio could be emitted.

Figure 2:
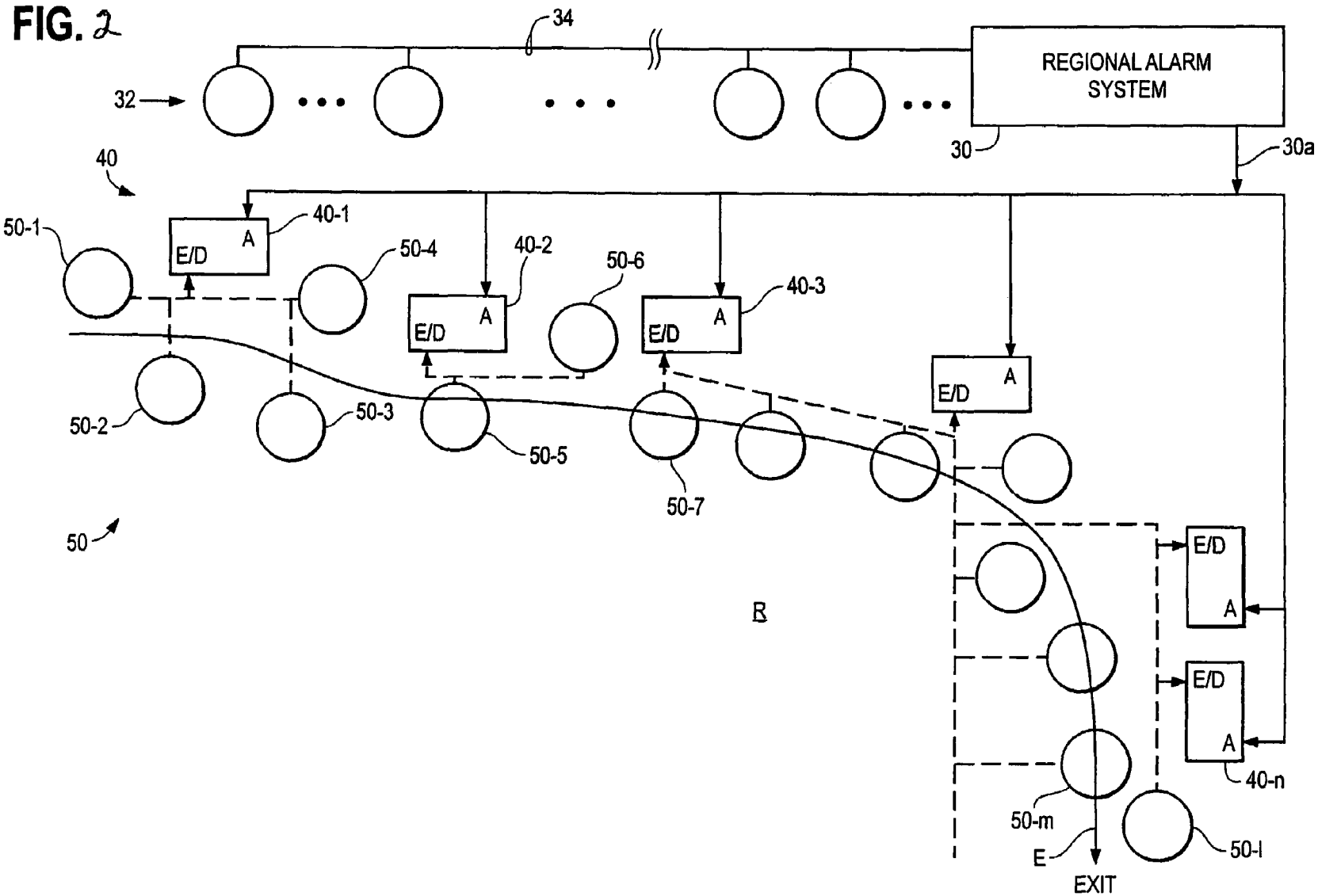
FIG. 2 is a top plan view of a system in accordance with the invention.

FIG. 2 illustrates a portion of the region R being monitored by a regional alarm system 30. Alarm system 30, as is conventional, incorporates a plurality of detectors 32 which might be dispersed throughout the region R.

The detectors 32 can be coupled by a wired or wireless medium 34, without limitation, to the alarm system 30. Alarm system 30 evaluates signals received from the members of the plurality 32 and determines, for example due to the presence of flame or smoke that a fire condition exists in a portion of the region R.

In response to such a determination, alarm system 30, via, for example line 30*a* can activate one or a plurality 40 of audible output devices, comparable to the device 10. Each of the members of the plurality 40, such as indicator 40-1, 40-2 . . . 40-n is located so as to identify or provide an audible indication of local conditions at or near an evacuation path E, or exit through some or all of the region R.

The members of the plurality 40, each incorporates an alarm signal input port A which is coupled to the line 30*a*. Hence, in a normal operation regional alarm system 30 can activate the members of the plurality 40 upon sensing an alarm condition somewhere in the region R. As noted above, this activation is without regard to local conditions in the vicinity of the units 40-*i*.

As described above, relative to device 10, FIG. 1, selected verbal messages, perhaps specified by addresses, detected by address circuitry 14*c*, can be emitted from the device 40-*i* along with directional, non-verbal audio. Different members of the plurality 40 can emit different messages.

Supplementing the alarm indicating signal on the line 30*a*, is a plurality of fire detectors 50. The members 50-1, 50-2 . . . 50-m are dispersed along portions of the evacuation route or path E and near the exit. The members of the plurality 50 provide feedback as to local smoke or fire related conditions on or adjacent to the pathway E, and adjacent to the exit. As described above, the members of the plurality 50 can be used to disable some or all of the non-verbal, directional audio indicators of the plurality 40 depending on local smoke/fire conditions adjacent to, along or in the vicinity of an exit. Such signals can also specify one or more verbal messages, from storage unit 16, to be emitted by device 40-*i*.

As illustrated in FIG. 2, detectors 50-1 . . . 50-4 coupled to the E/D port of indicator or enunciator device 40-1. If any of those detectors indicate a local alarm condition, which could be for example, sensed temperature, sensed smoke, sensed flame, sensed gases such as carbon dioxide, those detectors 50-1 . . . 50-4 which have detected a hazardous condition can suppress the directional non-verbal outputs of device 40-I based on a local sensed condition. The verbal messages can continue to be emitted to provide information.

Similarly, detectors 50-5, 50-6 which are coupled to the E/D port of path indicating device 40-2 can disable the non-directional audio but not necessarily, verbal outputs or visual output therefrom in the event of a hazardous condition on or in the vicinity of the pathway E in the immediate area of output device 40-2. It will also be understood that the devices 50-1 . . . 50-4 could also be coupled to the E/D port of output device 40-2 without departing from the spirit and scope of the present invention.

Similarly, output devices 40-3 . . . 40-n have E/D ports coupled to a plurality of detectors 50-7 . . . 50-m located along or adjacent to exit path E. Detectors 50-1, 50-m are located in the vicinity of the exit itself. Any of the detectors 50-7 . . . 50-m can disable directional audio outputs of any of the respective output indicating devices 40-3 . . . 40-n, but not the verbal outputs.

As it will be understood by those skilled in the art, one type of enable/disable port can have terminals which accept normally open and/or normally closed contacts. A change of state at one of these terminals, normally open contacts closing or normally closed contacts opening, causes the respective output indicating device to become disabled. For example, normally open or normally closed contacts from the respective detectors can be directly connected to this form of E/D input port.

In the case of normally open contacts, the detectors can be wired or connected in parallel to the port in order to provide an "or" function for the outputs of the respective detectors. Where the contacts are normally closed, the detectors can be wired in series to the E/D port of the indicating device to provide the "or" function. As those of skill in the art will understand, the detectors of the plurality 50 could be coupled to the respective members of the plurality 40 in accordance with their respective protocols to provide the desired "or" functionality.

It will also be understood that the verbal messages being emitted as well as the paths being identified can vary dynamically in response to conditions in the region R. In this regard, if a fire is spreading, the verbal messages being emitted can change from "pass through to the next sounder" to, "keep away, fire".

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. An alarm indicating sounder comprising:

a directional audible output device which when activated emits directional audible, non-verbal alarm indicating indicia;

a first input port for receipt of alarm indicating control signals to activate the output device;

a transducer for emitting predetermined, verbal messages associated with an alarm condition;

control circuitry coupled to the output device, the input port, and the transducer, the control circuitry, responsive to a received alarm indicating control signal, activates the directional output device to emit the directional alarm indicating indicia and the transducer to emit at least one predetermined message, where the message can be emitted in the absence of the directional alarm indicating indicia, which includes a second input port to disable the output device and, where the control circuitry emits at least one verbal message even when the output device is disabled.

2. A sounder as in claim 1 where the control circuitry activates the output device during a first time interval and activates the transducer during a second, different, time interval.

3. A sounder as in claim 1 where the first input port receives at least one predetermined message to be output by the transducer.

4. A sounder as in claim 3 where the at least one message can be stored locally.

5. A sounder as in claim 1 where the control circuitry emits a first, verbal, message, in the presence of an alarm state, when the output device has been activated and can emit the non-verbal alarm indicating indicia, and, a second, different verbal message when the output device has been disabled.

6. A sounder as in claim 5 where the first and second messages are stored locally at the control circuitry.

7. A sounder as in claim 6 where the first and second messages can be coupled to the control circuitry for storage locally relative thereto.

8. A system comprising;

an output device that provides at least two different audible outputs, one being a verbal the other being a non-verbal output, both outputs are indicative of an alarm condition, the device having an output disabling control port; and an ambient condition detector, the detector having at least one alarm output indicative of the presence of a predetermined alarm condition, the alarm output is coupled to the control port of the output device to at least intermittently disable the non-verbal output of the device in the presence of the predetermined alarm condition; and, where the detector comprises at least one of a smoke detector, a flame detector, a gas detector or a thermal detector.

9. A system as in claim 8 with the device including control circuitry coupled to the port responsive to a disabling signal received thereat.

10. A system as in claim 8 where the device includes message storage circuitry.

11. A system as in claim 10 where a signal received at the disabling control port specifies, at least in part, a verbal output message.

12. A system comprising:

an output device that provides at least two different audible outputs, one being a verbal the other being a non-verbal output, both outputs are indicative of an alarm condition, the device having an output disabling control port;

an ambient condition detector, the detector having at least one alarm output indicative of the presence of a predetermined alarm condition, the alarm output is coupled to the control port to at least intermittently disable the non-verbal output of the device in the presence of the predetermined alarm condition which includes:

a first plurality of ambient condition smoke detectors coupled by a medium to first control circuits;

a second plurality of the output devices coupled by a second medium to second control circuits; and a third plurality of ambient condition detectors, the detectors of the third plurality are coupled to respective ones of the output devices to disable outputs of directional, non-verbal audio therefrom in response to a locally sensed predetermined condition; where the mediums are different.

13. A system as in claim 12 where at least some of the output devices each include a disable port and where respective outputs from the at least some of the detectors of the third plurality are coupled to respective disable ports.

14. A system as in claim 12 where the first and second control circuits are coupled together.

15. A system as in claim 14 where the first control circuits provide control signals to the second control circuits.

16. A system as in claim 12 where at least some of the output devices continue to emit at least a verbal output in the absence of a non-verbal, directional audio output.

* * * * *